US010001119B2

(12) United States Patent
Lilie et al.

(10) Patent No.: US 10,001,119 B2
(45) Date of Patent: Jun. 19, 2018

(54) METHOD AND A SYSTEM FOR PROTECTING A RESONANT LINEAR COMPRESSOR

(71) Applicant: Whirlpool S.A., Sao Paulo (BR)

(72) Inventors: Dietmar Erich Bernhard Lilie, Joinville (BR); Paulo Sergio Dainez, Campinas (BR)

(73) Assignee: Whirlpool S.A. (BR)

( * ) Notice: Subject to any disclaimer, the term of this patent is extended or adjusted under 35 U.S.C. 154(b) by 206 days.

(21) Appl. No.: 15/203,346

(22) Filed: Jul. 6, 2016

(65) Prior Publication Data

US 2017/0009762 A1 Jan. 12, 2017

(30) Foreign Application Priority Data

Jul. 7, 2015 (BR) ..... 102015016317

(51) Int. Cl.

| | |
|---|---|
| ***F04B 35/04*** | (2006.01) |
| ***F04B 49/06*** | (2006.01) |
| ***F04B 39/00*** | (2006.01) |
| ***F04B 39/02*** | (2006.01) |
| ***F04B 53/10*** | (2006.01) |

(52) U.S. Cl.

CPC ..... *F04B 49/06* (2013.01); *F04B 35/04* (2013.01); *F04B 35/045* (2013.01);

(Continued)

(58) Field of Classification Search

CPC ..... F04B 49/06; F04B 35/04; F04B 39/0005; F04B 53/10

(Continued)

(56) References Cited

U.S. PATENT DOCUMENTS 5,428,965 A 7/1995 Grunwald et al.
5,947,693 A * 9/1999 Yang ..... F04B 49/06 417/44.11

(Continued)

FOREIGN PATENT DOCUMENTS

EP 2 023 480 A2 2/2009
WO WO 00/79671 A1 12/2000

OTHER PUBLICATIONS

Chun, Tae-Won et al., *A Novel Strategy of Efficiency Control for a Linear Compressor System Driven by a PWM Inverter*, IEEE Transactions on Industrial Electronics, vol. 55, No. 1, Jan. 2008, pp. 296-301.

(Continued)

*Primary Examiner* — Bentsu Ro
(74) *Attorney, Agent, or Firm* — Fay Sharpe LLP

(57) ABSTRACT

A method for protecting a resonant linear compressor (14) including structural resonance frequencies ($w_E$) and a motor that is fed by feed voltage ($V_a$) that has amplitude (A) and a drive frequency ($w_A$), both controlled according to the equation A·sin(wt). The protection method is configured so as to include the step of preventing feed to the motor at drive frequencies ($w_A$) that have at least one harmonic coinciding tithe the structural resonance frequency ($w_E$) of the resonant linear compressor (14). A protection system of a resonant linear compressor (14) includes an electronic control (30) configured to prevent feed to the motor at the drive frequencies ($w_A$) that have at least one harmonic coinciding with the structural resonance frequency ($w_E$) of the resonant linear compressor (14).

22 Claims, 13 Drawing Sheets

(52) U.S. Cl.
CPC ..... *F04B 39/0005* (2013.01); *F04B 39/0027* (2013.01); *F04B 39/023* (2013.01); *F04B 49/065* (2013.01); *F04B 53/10* (2013.01); *F04B 2201/0202* (2013.01); *F04B 2203/0402* (2013.01)

(58) Field of Classification Search
USPC ..... 318/606, 629
See application file for complete search history.

(56) References Cited

U.S. PATENT DOCUMENTS 5,980,211 A * 11/1999 Tojo ..... F04B 49/065 417/45
6,437,524 B1 * 8/2002 Dimanstein ..... H02P 25/032 318/119
6,501,240 B2 * 12/2002 Ueda ..... F04B 35/045 310/12.19

OTHER PUBLICATIONS

Chun, Tae-Won et al., *Method of Estimating the Stroke of LPMSM Driven by PWM Inverter in a Linear Compressor*, Applied Power Electronics Conference, APEC 2007—Twenty Second Annual IEEE, pp. 403-406.
Chun, Tae-Won et al., *Analysis and Control for Linear Compressor System Driven by PWM Inverter*, The Thirtieth Annual Conference of the IEEE Industrial Electronics Society, November, Korea 2004, pp. 263-267.
Sanada, Masayuki et al., *Analyses for Sensorless Linear Compressor Using Linear Pulse Motor*, IEEE Transactions on Industrial Electronics, vol. 4, Feb. 1999, pp. 2298-2304.
Lin, Zhengyu et al., A Resonant Frequency Tracking Technique for Linear Vapor Compressors, Electric Machines & Drives Conference Published in: Electric Machines & Drives Conference of IEEE International, IEMDC 2007, pp. 370-375.

* cited by examiner

METHOD AND A SYSTEM FOR PROTECTING A RESONANT LINEAR COMPRESSOR

CROSS REFERENCE TO RELATED APPLICATION

This application claims priority under 35 USC 119 to Brazilian Patent Application No. BR 102015016317-7 filed Jul. 7, 2015, and the entire disclosure of said Brazilian application is hereby incorporated by reference in its entirety into the present specification.

FIELD OF THE INVENTION

The present invention relates to a method and to a system for protecting a resonant linear compressor. More specifically, the present invention relates to a method and to a system configured so as to prevent the operation of a resonant linear compressor at a given drive frequency whose harmonic coincides with the structural resonance frequency of the compressor.

DESCRIPTION OF THE PRIOR ART

Alternating piston compressors generate pressure by compressing a gas inside a cylinder by means of the axial movement of a piston. In this regard, the gas existing in the outer part of the cylinder is in an area called low-pressure side (suction or evaporation pressure) and gets into the cylinder through a suction valve, where it is then compressed by the piston movement. After the gas has been compressed, it is expelled from the cylinder through a discharge valve to an area called high-pressure side (discharge or condensation pressure).

One of the types of alternating piston compressor is the resonant linear compressor. In this compressor model, the piston is actuated by a linear actuator, which comprises a support and magnets, being actuated by a coil and a spring, which associates the movable part (piston, support and magnets) to the fixed part (cylinder, stator, coil, head and frame). The movable parts and the spring form a resonant assembly of the compressor.

The resonant assembly actuated by the linear motor has the function of developing a linear alternating movement, causing the movement of the piston inside the cylinder to exert a compression action of the gas admitted through the suction valve as far as the point where it is discharged through the discharge valve.

For this reason, amplitude of operation of the resonant linear compressor is regulated by the balance of the power generated by the motor and the power consumed by the mechanism in the compression, besides the losses generated in this process. Thus, in order to achieve maximum thermodynamic efficiency, resulting in maximum cooling capacity, the piston displacement should draw near to the stroke end (as close to the head as possible), so as to reduce the volume of dead gas (unused gas) in the compression process.

Thus, in order to make the compression process feasible with maximum efficiency, it is necessary to have precision in the analysis and knowledge of the piston stroke, preventing the risk of impact of the piston against the stroke end, which would generate acoustic noise, loss of efficiency and even a possible break of the resonant linear compressor.

So, the greater the error in detecting the piston stroke the greater the safety coefficient necessary between the maximum piston displacement and the stroke end, increasing losses of output in the product.

On the other hand, the system has lesser need for cooling, and so it is necessary to reduce the cooling capacity of the resonant linear compressor. It is possible to reduce the power stroke of the piston, thus diminishing the power supplied to the system, promoting a variable cooling capacity of the compressor, which may be controlled by controlling the piston stroke.

Besides, another important characteristic of resonant linear compressors is the drive frequency. The system in which such compressor are used are designed to operate at a specific resonance frequency of the mass/spring system, since at this point the reactive forces of the system are annulled and, as a result, the system reaches maximum efficiency. Such drive frequency is derived from the actuation of the spring of the resonant linear compressor and from the amplitude A of the Aa feed voltage on the piston.

By "mass/spring" one understands that mass (m) the sum of the mass of the movable part (piston, support and magnet) and the equivalent spring ($K_T$) is the sum of the resonant spring of the system ($K_{ML}$) plus the gas-compression force which, since it is dependent upon the evaporation and condensation pressures of the cooling system, as well as of the gas used for compression, may be modeled to one more spring constant ($K_G$).

Such theories can be found in papers of the *IEEE*, as for example, "*A Novel Strategy of Efficiency Control for a Linear Compressor System Driven by a PWM Inverter*" (by authors T. Chun, J. Ahn, H. Lee, H. Kim and E. Nho), as well as "*Method of Estimating the Stroke of LPMSM Driven by PWM Inverter in a Linear Compressor*" (by authors T. Chun, J. Ahn, Q. Tran, H. Lee and H. Kim), "*Analysis and control for linear compressor system driven by PWM inverter*" (by authors T. Chun, J. Ahn, J. Yoo and C. Lee) and "*Analysis for sensorless linear compressor using linear pulse motor*" (by authors M. Sanada, S. Morimoto and Y. Takeda).

In this regard, the paper "*A Resonant Frequency Tracking Technique for Linear Vapor Compressors*" (by authors Z. Lin, J. Wang and D. Howe) presents another theory that such mass/spring systems can calculate a resonance frequency ($f_r$) by the equations (1) and (2) below:

$$K_T = K_{ML} + K_G \tag{1}$$

$$f_R = \frac{1}{2.\pi}\sqrt{\frac{K_T}{m}} \tag{2}$$

Since the spring gas portion is unknown ($K_G$), non-linear and variable throughout the operation of the resonant linear compressor, it is not possible to calculate the resonance frequency with the precision necessary to optimize the efficiency of this type of compressor. This paper also presents a theory of adjusting resonance frequency, where one applies a variation of drive frequency as far as the maximum power point, for a constant current, thus presenting a simple and easy-to-implement method, which, however, needs to disturb the system periodically to detect the resonance frequency.

Further, as can be seen in the already cited papers and additionally in document WO0079671, when the system operates at the resonance frequency, the motor current is in quadrature with the displacement, that it, the motor current is in phase with the counter-electromotive force (CEMF, or back-EMF) of the motor (considering that the CEMF is proportional and derived from the displacement). This method is more precise to optimize the efficiency of the compressor, but it needs constant detection of the current phase and of the displacement phase, thus needing position or velocity sensing cars.

If the structural resonance frequencies are excited, this originates disturbances in the functioning of the resonant linear compressor, which may vary from the increase in acoustic noise to the break thereof. Therefore, control methods are necessary so that such (structural resonance) frequencies will not be excited or, alternatively, methods that prevent the resonant linear compressor from operating at such frequencies. One of the viable approaches is the mechanical modification in the compressor construction, so that the structural resonance frequencies will be outside the area of the harmonic of the main resonance frequency of the system.

However, due to the variability of the productive process and of the variation in the main resonance frequency (due to variation of the charge), it may not be possible to prevent harmonics of the drive frequency from exciting structural resonances.

Thus, another approach would be to prevent the drive of the system at frequencies that have harmonics that excite the structural resonance frequencies. This solution may lead to a minor drop in efficiency of the system, due to the fact that the compressor is not actuated exactly at the resonance frequency (when a harmonic of the later coincides with a structural resonance), but, on the other hand, this guarantees the reliability and durability of the compressor.

Solutions to this problem appear only on rotary motors, as shown, for instance, in document U.S. Pat. No. 5,428,965, which describes a control system for variable-speed motors, which prevents drive of the motor at certain velocities to prevent excessive noise or vibrations, or document EP 2,023,480, which describes the control of rotary motors that modifies the current phase to prevent drive at these frequencies, reducing the noise and vibrations of the motor.

These techniques, however, are not easy to apply for linear motors. On rotary motors there is a control over the frequency of operation of the compressor, that is, one can vary the operation frequency without concerns relating to losses of the system.

Thus, rotary motors have an effect that is totally different from that of linear motors. As already explained, electric motors that have magnets produce a force that is contrary to motion force of the motor, called counter-electromotive force (CEMF). This CEMF ends up limiting the voltage (and, as a result, the current that is applied to the motor. So, modifying the phase of the current applied on rotary motors with respect to the CEMF makes the application of a higher current with respect to the phase with the CEMF (called also field suppression on rotary machines) impossible. Since the frequencies of these compressor is determined only by the motor, a rotary compressor can modify the operation frequency upon modifying the frequency of its inverter, without any concern with loss of efficiency, since its energy is constant, always determined by the value of the kinetic energy.

This effect, however, is different for resonant linear machines, the later operating at the main resonance frequency of the system, this being the function of the product design, which may undergo minor variations due to the gas compression effect.

Factors like the temperature in the environment in which the compressor is arranged may also interfere with the main resonance frequency of the system. For instance, in cold environments the main resonance frequency of the resonant compressor is at 110 Hertz. On the other hand, in a warmer environment, as the discharge pressure of the compressor increases, the main resonance frequency reaches 130 Hertz.

In other words, there is no control over the operation frequency of the compressor, so that this frequency may vary in a short period of time (due to weather variations).

During the movement of resonant motors, there is a constant change of kinetic energy and potential energy, the resonance frequency being the point at which the kinetic energy and the potential energy have the same amplitude. At this frequency, when the piston is at its maximum speed, the kinetic energy represents the whole energy of the system, whereas at the uppermost or lowermost points (top or bottom dead center), the potential energy represents the whole energy of the system and the total energy of the system is always constant, oscillating between kinetic and potential energy.

Upon modifying the frequency, that is, upon getting out of the resonance, the potential energy or the kinetic energy will prevail in the system, and the additional energy to keep the balance (and the functioning of the system) shall be produced by an external system, which in this case is the motor. In this way, if the operation frequency on a resonant linear compressor is different from the main resonance frequency, the motor of this compressor will view a relative charge that is additional to the system, which does not generates work, but consumes energy (in this case, accelerating and decelerating the piston, which at the resonance frequency is carried out automatically by the spring in the exact extent to annul any reactive charge).

Since linear compressor should always operate at the resonance frequency, factors like variations in the charge or temperature may modify the operation frequency, and this frequency should be accompanied by the inverter of the motor, for better drive efficiency.

Thus, modification of frequency on linear machines may not be considered obvious with respect to modification on rotary machines, since on linear compressors modification in the frequency (operation of the compressor out of resonance) will generate reactive loads which must be absorbed by the compressor motor. On rotary compressors, as already mentioned, the variation in the frequency does not entail great losses for the system.

Thus, there is no description, in the prior art, of a method or a simple and useful system that prevents the operation of a resonant linear compressor at drive frequencies whose harmonics coincide with the structural resonance frequency of the system.

BRIEF DESCRIPTION OF THE INVENTION

This application describes a method for protecting a resonant linear compressor, such a compressor comprising structural resonance frequency and a motor that is fed by a feed voltage that exhibits an amplitude and a drive frequency, both controlled according to the equation $A \cdot \sin(wt)$.

The protection method is configured so as to comprise a step of preventing feed to the motor at drive frequencies that have at least one harmonic coinciding with the structural resonance frequency of the resonance linear compressor.

The present invention further relates to a system for protecting a resonant linear compressor, which comprises an electronic control and is configured so as to prevent feed to the motor at drive frequencies that have at least one harmonic coinciding with the structural resonance of the resonant linear compressor.

BRIEF DESCRIPTION OF THE DRAWINGS

The present invention will be described in greater detail with reference to an embodiment represented in the drawings. The figures show.

DETAILED DESCRIPTION OF THE FIGURES

Figure 1:
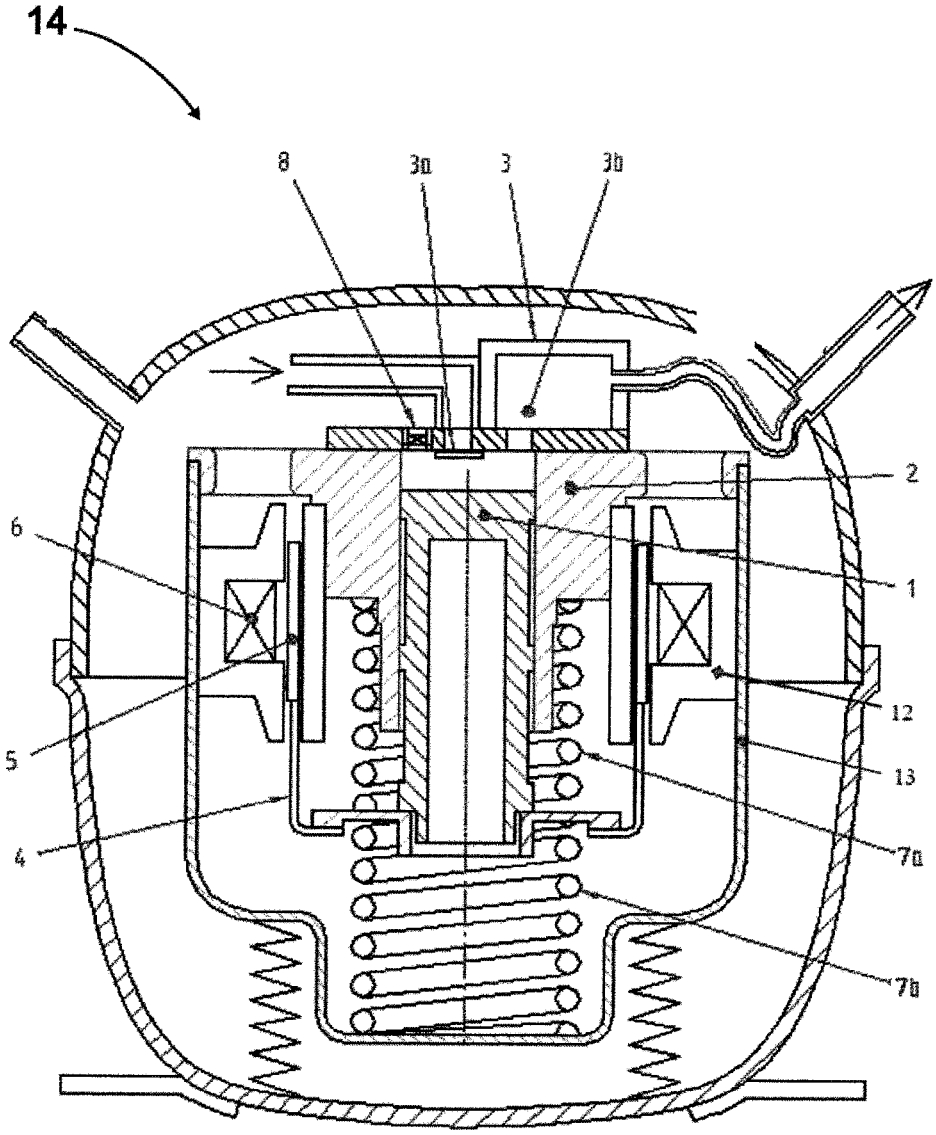
FIG. 1—is a cross-sectional view of a resonant linear compressor.

FIG. 1 illustrates the embodiment of the resonant linear compressor 14, in which the system and the method proposed in the present invention are applied. For a better understanding of the figures, the resonant linear compressor 14 will be described only as compressor 14, in a few situations.

Said compressor 14 comprises a piston 1, a cylinder 2, a suction valve 3*a* and a discharge valve 3*b*, besides having also a linear actuator comprising a support 4 and magnets 5, the latter being actuated by one or more coils 6.

The resonant linear compressor 14 further has one or more springs 7*a* and 7*b*, which connect a movable part of the compressor 14, comprising the piston 1, the support 4 and the magnets 5, a fixed part of the compressor 14, comprising the cylinder 2, a head 3, at least one stator 12, to which the coils 6 are fixed, and a structure 13 for fixation of all the elements necessary for the correct operation of the compressor 14.

During the operation of the compressor 14, the gas gets into the cylinder 2 through the suction valve 3*a* and is compressed by a linear movement of the piston 1, being later expelled from the system by the discharge valve 3*b*. The movement of the piston 1 in the cylinder 2 is made by actuation of the coils 6 of the stator 12 on the magnets 5 associated to the support 4, besides the opposite movement made by actuation of the springs 7*a* and 7*b* on the same support 4.

Figure 2:
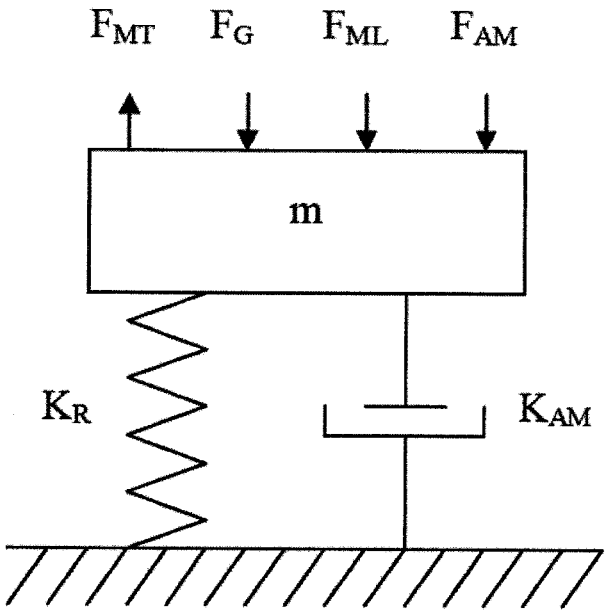
FIG. 2—is a mechanic model of the resonant linear compressor.

In this regard, FIG. 2 presents a mechanical model of the compressor 14 (mass/spring mechanical system) of FIG. 1, wherein equation (3) can be obtained (3).

$$m \cdot \frac{\delta^2 d(t)}{\delta t^2} = F_{MT}(i(t)) - F_{ML}(d(t)) - F_{AM}(v(t)) - F_G(d(t)) \tag{3}$$

In equation (3), the motor force in Newton is defined by $F_{MT}(i(t))=K_{MT}\cdot i(t)$, whereas the spring force, also in Newton, defined by $F_{ML}(d(t))=K_{ML}\cdot d(t)$. The dumping tons is modeled or $F_{AM}(v(t))=K_{AM}\cdot v(t)$ and similarly the gas-pressure force within the cylinder, again in Newton, is defined by $F_G(d(t))$. In these equations, $K_{MT}$ is the modeling of a spring constant of the motor (motor constant), whereas $K_{ML}$ is the é the spring constant and $K_{AM}$ represents the modeling of the damping constant.

The mass of the movable part of the system is defined by m, the piston velocity being defined by v(t), the piston displacement by d(t) and the current in the motor by i(t).

Figure 3:
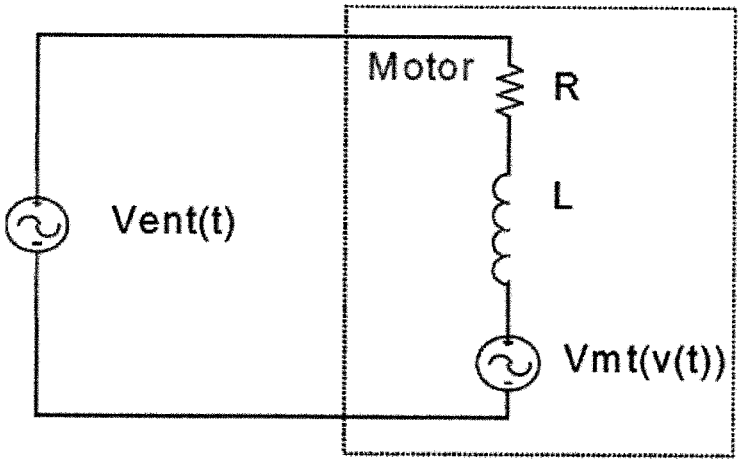
FIG. 3—is an electric model of the resonant linear compressor.

FIG. 3 shows an electric modeling (RL electric circuit in series with a strong voltage) of the compressor 14 of FIG. 1, in which one can obtain the equation (4).

$$V_{ENT}(t)=V_R(i(t))+V_L(i(t))+V_{MT}(v(t)) \tag{4}$$

In this equation (4), the voltage of the resistance in Volts is modeled by $V_R(i(t))=R\cdot i(t)$, wherein R is the electric resistance of the motor. On the other hand, the inductor voltage, also in volts, is modeled by $$V_L(i(t)) = L \cdot \frac{di(t)}{dt},$$

wherein L represents the motor inductance.

The voltage induced in the motor (CEMF) in Volts is represented by $V_{MT}(v(t))=K_{MT}\cdot v(t)$, whereas the feed voltage, also in Volts, is represented by $V_{ENT}(t)$.

The gas-pressure force $F_G(d(t))$ is not constant, the latter being variable as a function of the changes in suction pressure and discharge pressure and, as a result, with piston displacement.

The other forces in the mechanical equation (mass/spring modeling), as well as all the voltages of the electric equation (RL circuit), are linear functions. In order for us to achieve a complete model of the system, it is possible to replace the pressure force by the modeled effects which it causes in the system, said effects being the consumption of power and the variation in the resonance frequency.

The consumption of power may be modeled by an equivalent (variable) damping, whereas the variation in the resonance frequency is modeled by an equivalent spring (also variable).

Thus, the equation (3) may be re-written according to the equation (5) or (6) bellow.

$$m \cdot \frac{\delta^2 d(t)}{\delta t^2} = K_{MT} \cdot i(t) - (K_{ML} - K_{MLEq}) \cdot d(t) - (K_{AM} + K_{AMEq}) - v(t) \quad (5)$$

$$m \cdot \frac{\delta^2 d(t)}{\delta t^2} = K_{MT} \cdot i(t) - K_{MLT} \cdot d(t) - K_{AMT} \cdot v(t) \quad (6)$$

In these equations (5) and (6), $K_{MLEq}$ determines the modeled coefficient of the equivalent spring, whereas $K_{AMEq}$ represents the equivalent damping equivalent. The total spring coefficient, $K_{MLT}$, may be calculated as $K_{MLT}=K_{ML}+K_{MLEq}$.

In the same way, the total damping coefficient may be calculated as $K_{AMT}=K_{AM}+K_{AMEq}$. Thus, upon applying the Laplace transform to equations (4) and (6) it is possible to obtain the equation (7), which represents the electric equation in the frequency domain, besides the mechanical equations (8) and (9), which represent the transfer function between the displacement and the velocity relating to the current, as shown below:

$$I(s) = \frac{V_{ENT}(s) - K_{MT}.V(s)}{L.S + R} \quad (7)$$

$$\frac{D(s)}{I(s)} = \frac{K_{MT}}{m.s^2 + K_{AMT}.s + K_{MLT}} \quad (8)$$

$$\frac{V(s)}{I(s)} = \frac{K_{MT}.s}{m.s^2 + K_{AMT}.s + K_{MLT}} \quad (9)$$

Thus, the mechanical resonance frequency is given by the module of the pair of complex poles of the equation characteristic of the mechanical system, this being the frequency at which the system exhibit better relation between current and displacement (or velocity), that is higher efficiency.

Figure 4:
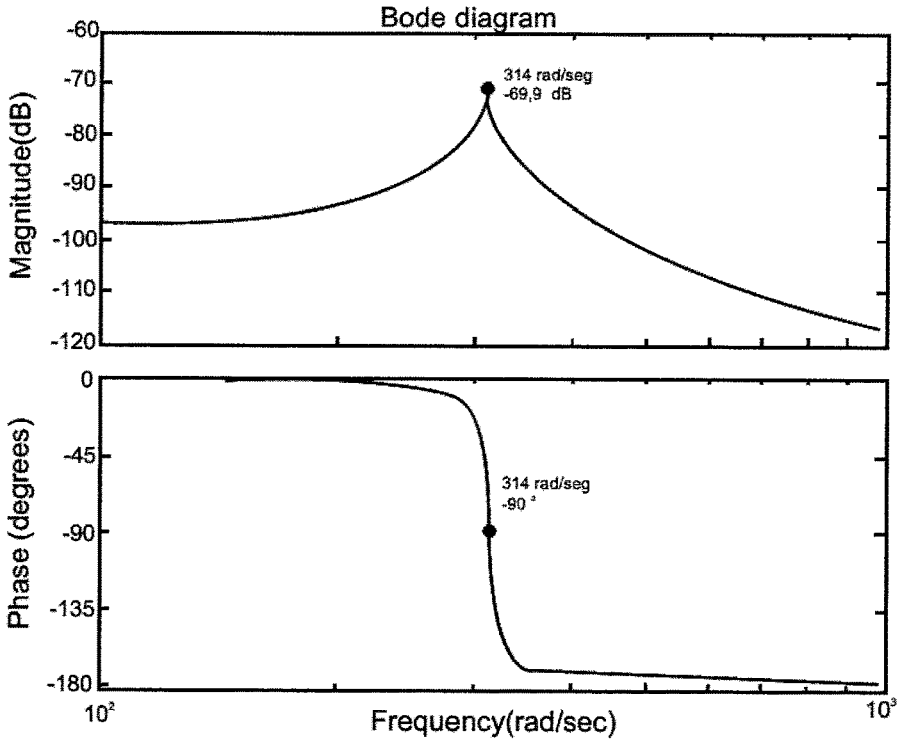
FIG. 4—is a response diagram at frequency of the function of displacement transfer of the mechanical system.
Figure 5:
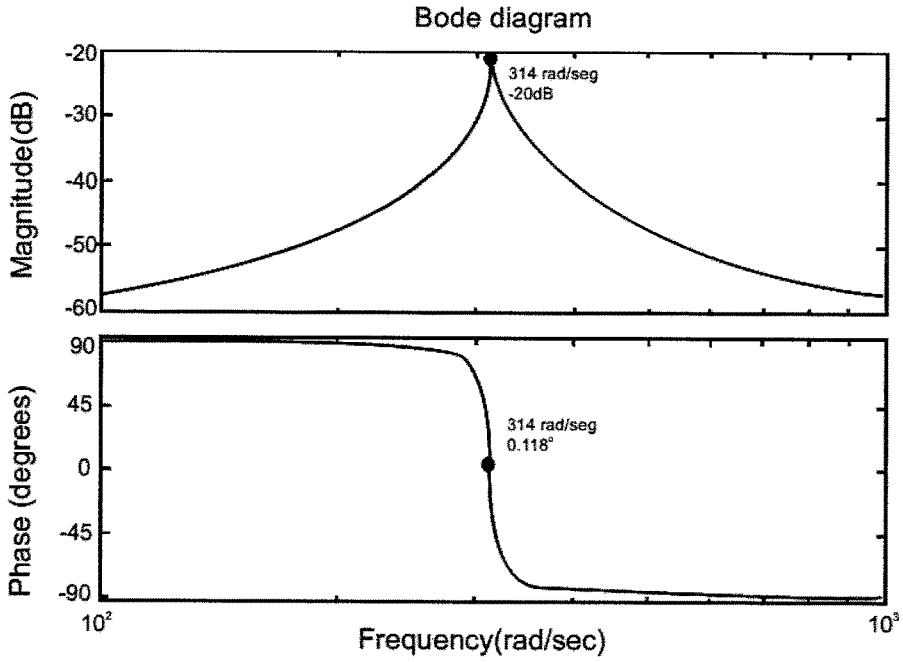
FIG. 5—is a response diagram at frequency of the velocity of the mechanical system.

FIGS. 4 and 5 show reply diagrams at frequency (Bode diagrams) of the transfer function of the displacement of the mechanical system (FIG. 4) and of the velocity of the mechanical system (FIG. 5). In these figures, one observes that at the mechanical resonance frequency the system gain is maximum (maximum magnitude). Further, the displacement is offset 90 degrees with respect to the current (displacement and current are in quadrature) and the velocity is in phase with respect to the current (phase between velocity and current is of 0 degree).

Thus, the variations in load may be represented by variations in the total spring coefficient and in the total damping coefficient, these factors will affect the resonance frequency and the gains of the system.

The structural resonances may be represented as a mass/spring system, as in FIG. 2 and conforming to the equation (3), but without undergoing influence of the load and depending only on the dimension characteristics of the compressor 14. In other words, the structural resonance is constant for the same compressor 14 (even considering variations in temperature), but it varies between different compressors, that is, the structural resonance is never identical.

Because of this, the structural resonance exhibit low dampening and a high spring constant, so that their (structural) resonance frequency is considerably higher than the main resonance frequency of the system, being possible located on harmonics of the main resonance frequency of the system (drive frequency).

Thus, and just as mentioned before, the operation of the linear compressor 14 at the structural resonance frequencies may entail damage to the compressor 14, so that it is advisable that the functioning of the compressor 14 at such frequency should be prevented.

In this regard, the present invention discloses a method and a system for protecting a resonant linear compressor 14 which have the objective of preventing the operation of the compressor 14 at the structural resonance frequency of the system. In other words, the present invention relates to a method and to a system for protecting a resonant linear compressor 14 which prevent harmonics of the drive frequency from coinciding with the structural resonance of the system.

Such a resonant linear compressor 14 comprises structural resonance frequencies $w_E$ and a motor, the latter being fed by a feed voltage Va provided with amplitude A and a drive frequency $w_A$, both controlled according to the equation A·sin(wt).

Figure 6:
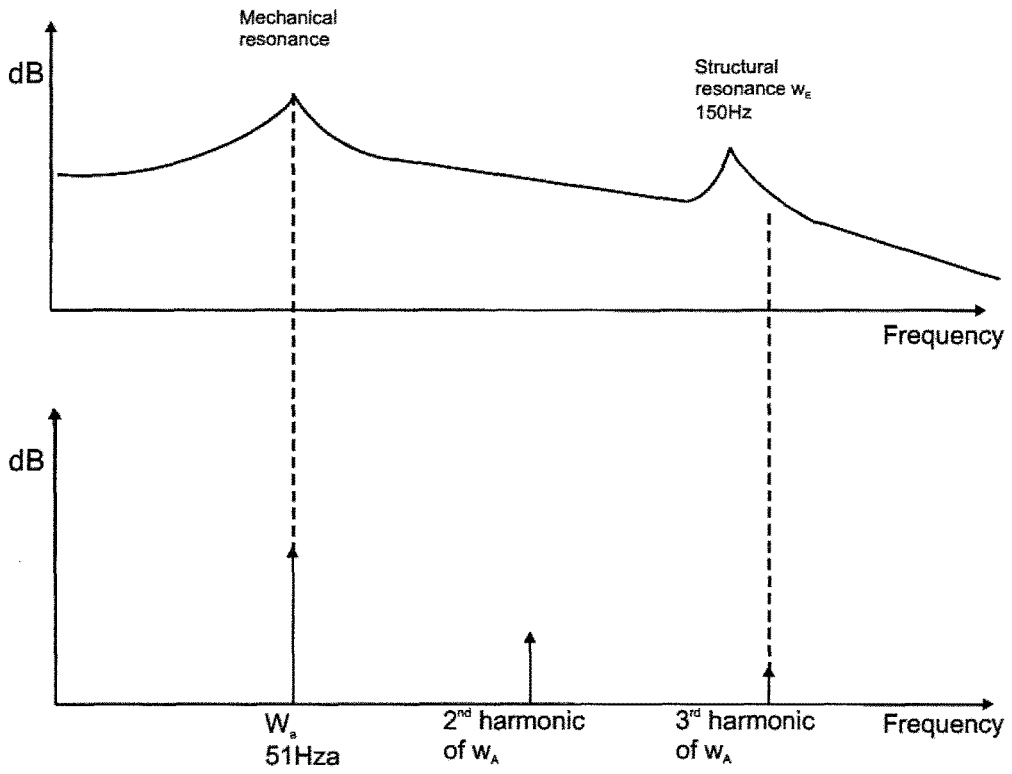
FIG. 6—represents a graph of the drive frequency (Hertz) of the resonant linear compressor as a function of its vibration.
Figure 7:
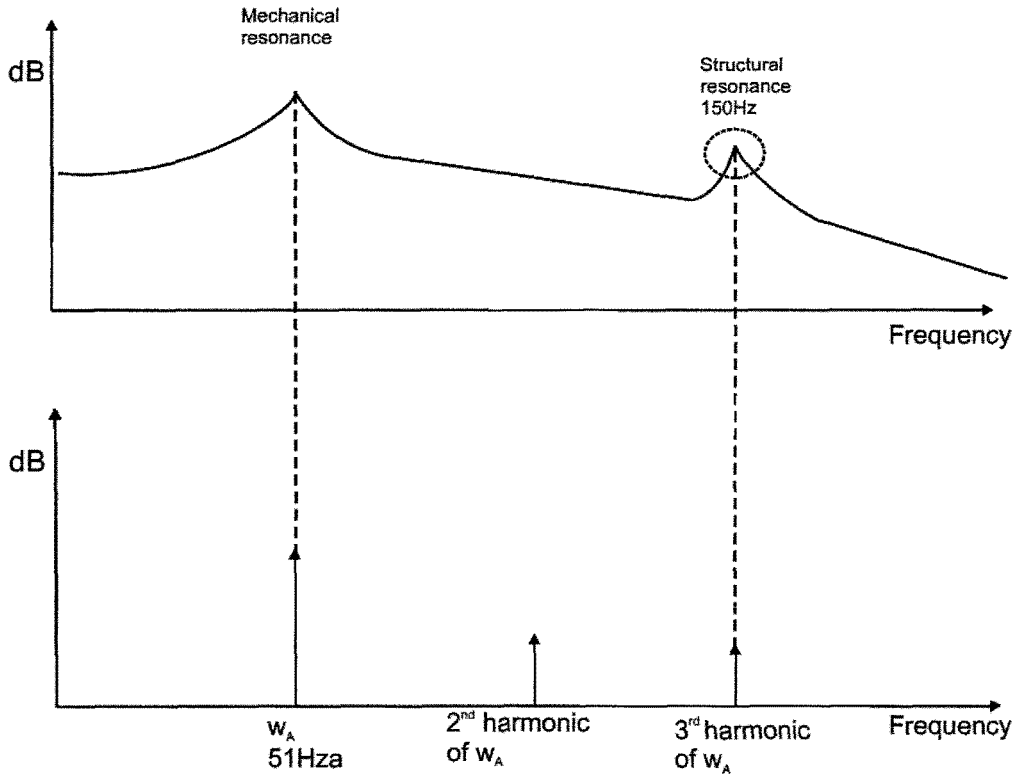
FIG. 7—represents a graph of the drive frequency (Hertz) of the resonant linear compressor as a function of its vibration.
Figure 8:
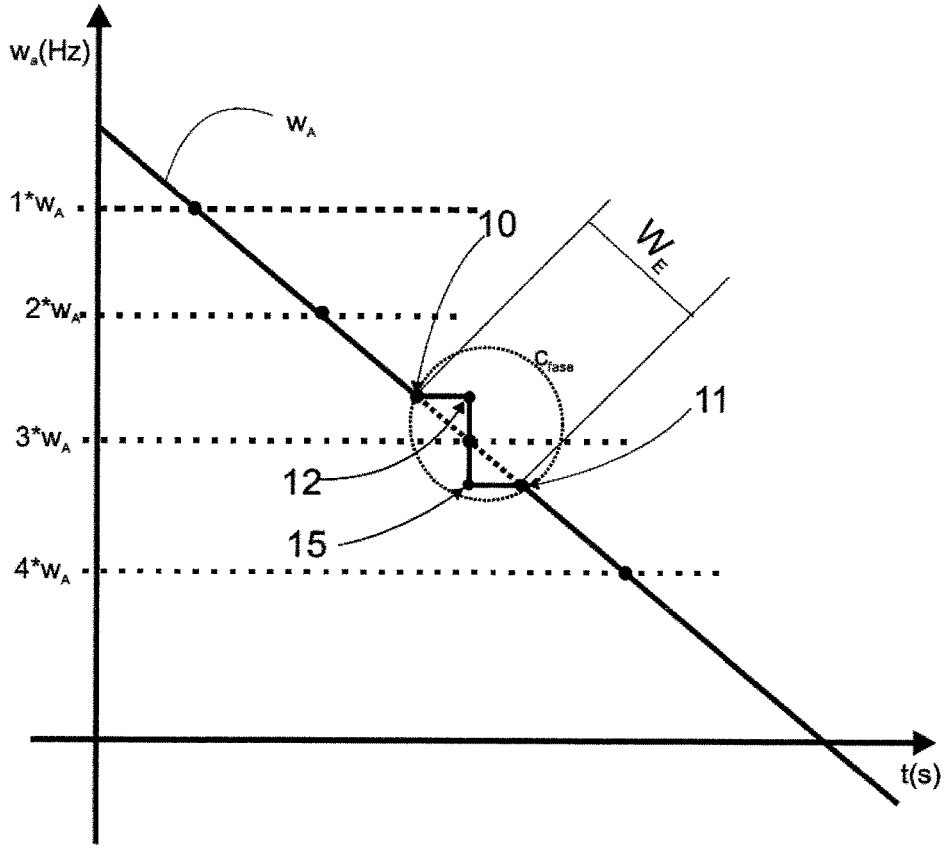
FIG. 8—represents a time graph (seconds) as a function of the drive frequency (Hertz) of a resonant linear compressor.

FIGS. 8 and 7 show a graph of the drive frequency of the linear compressor 14 as a function of its variation. One observes in FIG. 6 that the third harmonic of the drive frequency $w_A$ is above the structural resonance of the system.

The situation that one wishes to prevent in order to protect the linear compressor 14 and the system which it integrates is shown in FIG. 7. In this case, one observes that the third harmonic of the drive frequency $w_A$ is equal (coincides with) to the structural resonance of the system, which entails excess vibration to the resonant linear compressor 14.

In order to prevent operation of the resonant linear compressor 14 at harmonics of the drive frequency $w_A$ from coinciding with the structural resonance frequency $w_E$ of the system, one starts from the presupposition that the latter is known. For this purpose, for instance, one can detect the counter-electromotive force of the linear actuator or still use a sensor for sensing position or velocity of the piston of the resonant linear compressor 14.

In the method and in the system for protecting a resonant linear compressor 14, as proposed in the present invention, one considers a resonant linear compressor 14 in which one knows that the structural resonance frequency $w_E$ coincides with the third harmonic of the drive frequency, as shown in FIG. 7.

FIG. 8 shows a time graph (seconds) as a function of the drive frequency $w_A$, at Hertz, of the resonant linear compressor 14. One observes that in this situation the drive frequency of the compressor 14 drops as a function of the time. As already mentioned, such a situation may occur due to the drop in temperature of the environment in which the compressor 14 is arranged.

Thus, during the variation in drive frequency $w_A$ of the compressor, it may happen that a harmonic of the drive frequency $w_A$ coincides with the structural resonance frequency $w_E$, a situation which, as already mentioned, one wishes to prevent.

The structural resonance frequency $w_E$ of the compressor 14 is indicated from the dashed line of the operation frequency $w_A$. One observes that such a frequency coincides with the third harmonic of the drive frequency $3*w_A$. Thus, it is desirable to prevent the drive of the compressor at the drive frequency $w_A$ coinciding with the structural resonance frequency $w_E$.

For this purpose, the method for protecting a resonant linear compressor 14 as proposed in the present invention alters the drive frequency $w_A$ by varying the phase between the electric current i(t) of the compressor 14 and the velocity of piston displacement. In this way, the efficiency of the compressor is slightly impaired. On the other hand, noises and excess disturbances are prevented on it.

Knowing the structural resonance frequency $w_E$ of the system, an electronic control of the linear compressor 14, upon detecting a point higher than 10 of the structural resonance frequency $w_E$, will advance the phase between the electric current i(t) of the compressor 14 and the velocity of piston displacement.

Upon reaching the point at which the phase may not be offset any longer (minimum offset value 12), the later should be delayed and will later return to phase 0°, thus causing a "frequency jump". This frequency jump will jump over the structural resonance frequency $w_E$ of the system, thus preventing the noises and vibrations that may damage the linear compressor 14.

In a similar way, this jump in the structural resonance frequency $C_{fase}$ is carried out if the linear compressor 14 is arranged in an environment in which the room temperature is rising. In this situation, the electronic control, upon detecting a lower point 11 of the structural resonance frequency $w_E$ will delay the phase between the current and the displacement until the maximum offset value 15 and then will reestablish it and later return to the phase 0°, thus causing said "jump" in the structural resonance frequency $w_E$.

Figure 9:
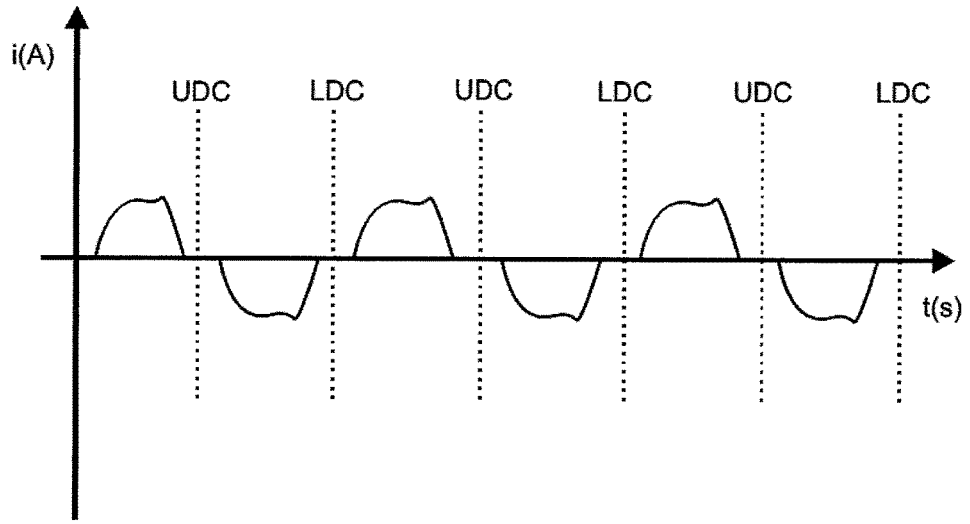
FIG. 9—is a time graph (seconds) as a function of the current (amperes) indicating the ideal condition of operation of a resonant linear compressor.
Figure 10:
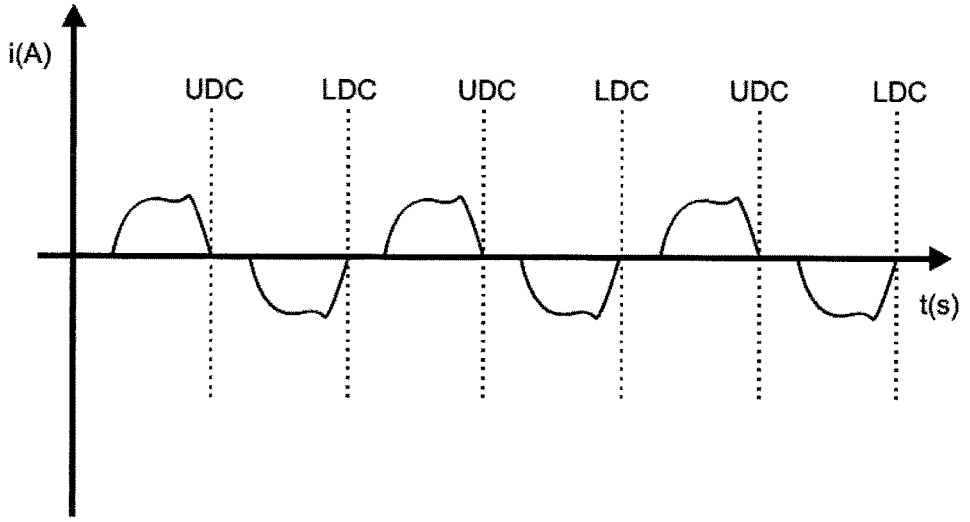
FIG. 10—is a graph representing the control of the drive frequency of the resonant linear compressor upon delaying the current phase.
Figure 11:
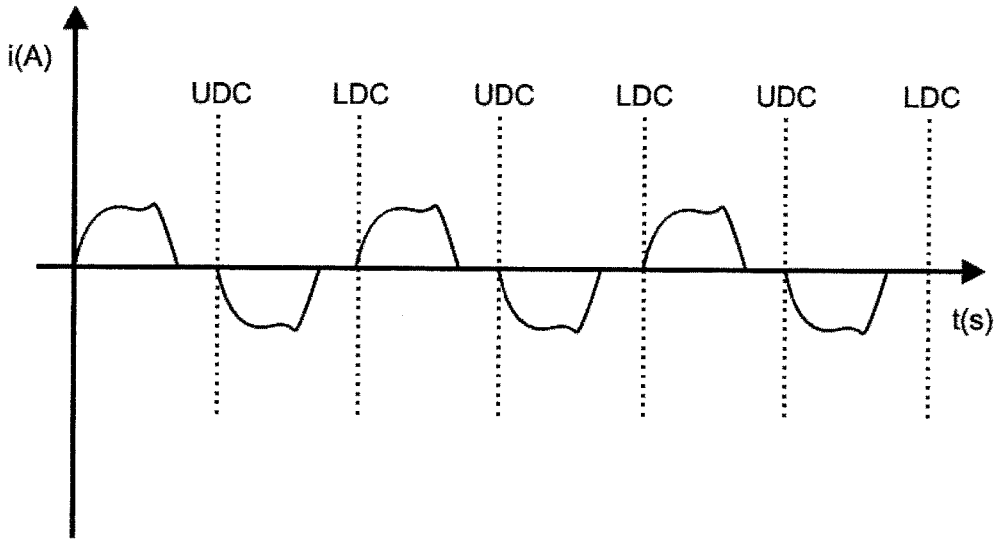
FIG. 11—is a graph representing the control of the drive frequency of the resonant linear compressor upon advancing the current phase.

FIGS. 9, 10 and 11 represent a graph of the time (seconds) as a function of the current (amperes) of the linear compressor 14. FIG. 9 represents the ideal functioning condition of said compressor 14 (compressor 14 operating perfectly at the resonance, that is, actuating symmetrically in the two directions of piston displacement), this situation being represented in FIG. 9 and indicating the operation of the compressor 14 out of the structural resonance frequency $w_E$.

The delay in the offset of the current is indicated in the graph of FIG. 10, in which one observes that the end of the current gets close to the upper dead center (UDC) and to the lower dead center (LDC) of the piston displacement. On the other hand, the operation frequency of the compressor 14 is lower if compared with the operation frequency indicated in FIG. 9.

The graph shown in FIG. 11 represents the current advanced in phase if compared with the graph in FIG. 10. In this situation, the start of the current gets close to the PMS and PMI and the operation frequency of the compressor 14 is higher is compared with the frequency indicated in FIG. 10.

It is valid to mention that, although this preferred embodiment of the present invention describes this jump in the structural resonance frequency $C_{fase}$ for the third harmonic of the drive frequency, in another linear compressor, this "jump" in the frequency might occur, for example, in the fourth harmonic.

Figure 12:
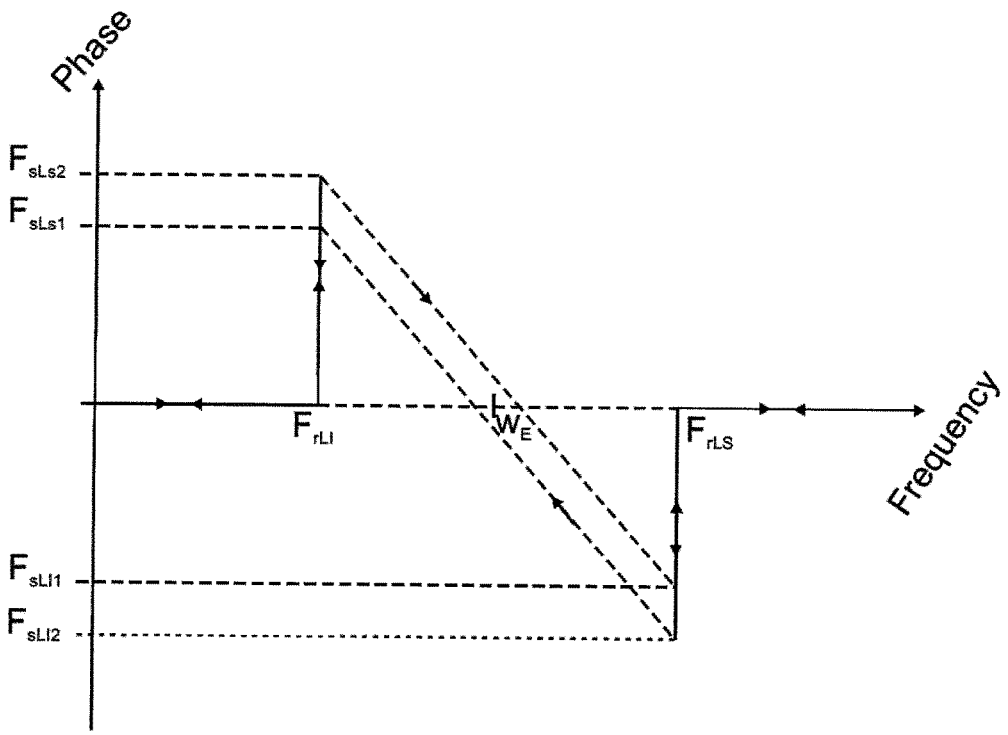
FIG. 12—is a representation of the drive frequency of the resonant linear compressor as a function of the phase between the electric current and the piston displacement velocity.

Additionally, FIG. 12 a representation of the frequency of the linear compressor 14 as a function of the phase between the electric current i(t) and the piston velocity. As in the graph shown in FIG. 8, but now shown in the so-called hysteresis signal, FIG. 12 shows the phase control for preventing drive of the compressor 14 at the structural resonance frequency $w_E$ of the system.

In this graph and more precisely at the abscissa axis, one represents a lower limit and an upper limit for the structural resonance frequency $w_E$, called $F_{rLI}$ and $F_{rLS}$, respectively. Thus, in the regions in which the drive frequency $w_A$ of the compressor 14 is $F_{rLI}<w_A<F_{rLS}$, region is configured in which one wishes to prevent drive of the compressor 14, that is, the region in which said "frequency jump" will take place.

On the other hand, the ordinate axis refers to the phase between the current and the velocity and the graph shown in FIG. 12, represents a first lower limit of the phase $F_{sLI1}$, a second lower limit of the phase $F_{sLI2}$, a first upper limit of the phase $F_{sLS1}$ and a second upper limit of the phase $F_{sLS2}$.

Figure 13:
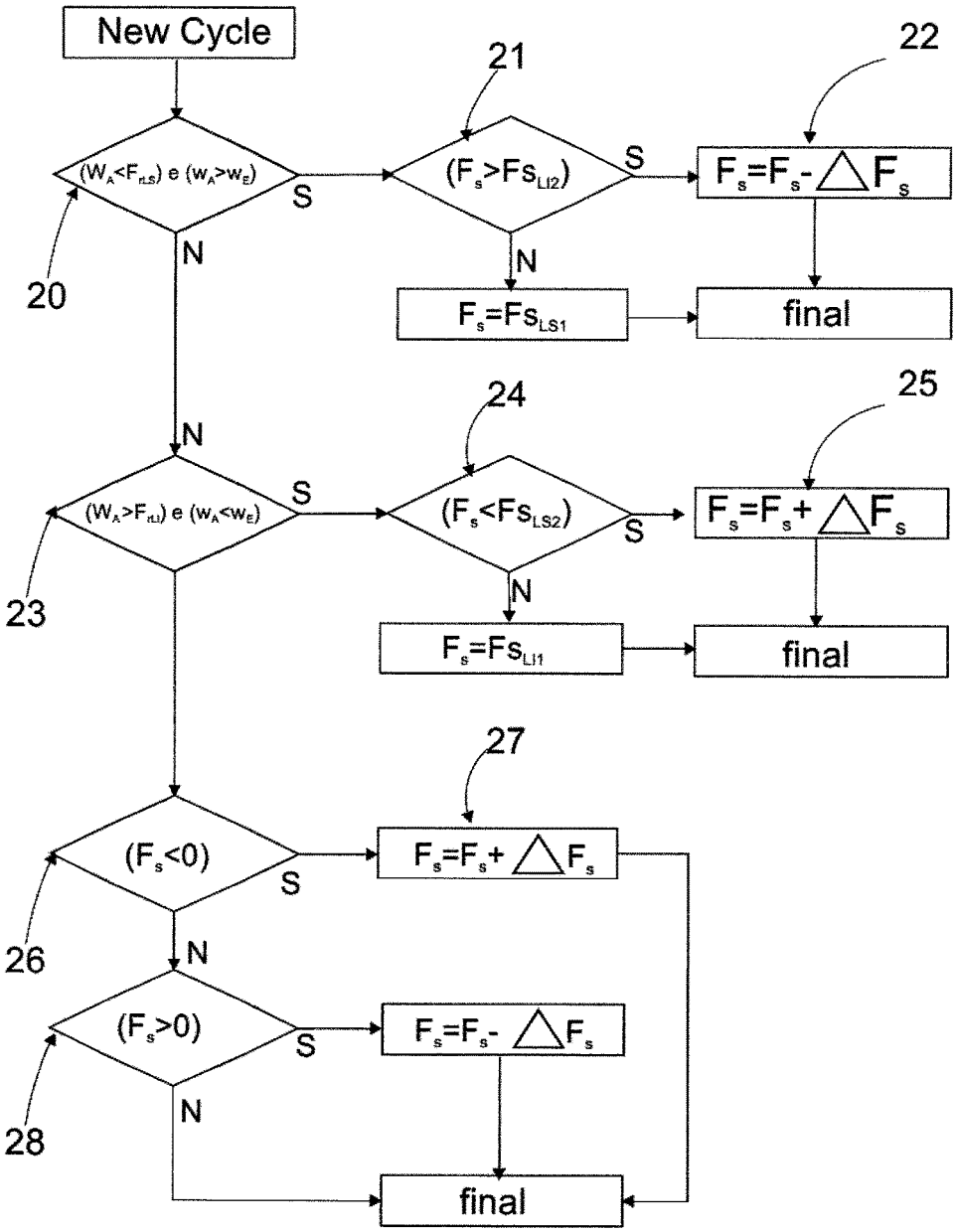
FIG. 13—represents a flowchart describing the "phase jump" according to the method proposed in the present invention.

FIG. 13 represents a flowchart describing the "phase jump" shown in the graph of FIG. 11. One observes that at the start of a new cycle of piston displacement 1, the decision step 20 verifies whether ($w_A<F_{rLS}$) and ($w_A>w_E$), which indicates the region between $w_E$ and $F_{rLS}$ (FIG. 12). If so, the decision step 21 verifies whether $F_s>Fs_{LI2}$ and, if so, the phase between the current and the velocity will be advances (operation step 22), assuming the velocity as a reference.

If not, the phase $F_s$ will be reestablished, assuming the value of the $F_{sLs1}$, as shown in FIG. 12.

If the step 20 give a negative result, the condition step 23 will verify whether ($w_A>F_{rLI}$) and ($w_A<w_E$), which would represent the region between $F_{rLI}$ and $w_E$ (FIG. 12). In this case, the condition step verifies whether $F_s<F_{sLS2}$, if so, the phase of the current with respect to the velocity will be delayed, according to the operation step 25. It not, the current phase will be reestablished, assuming the value of $F_{sLI1}$, as shown in FIG. 12.

Thus, the phase values of the second lower limit $F_{sLI2}$ and of the second upper limit $F_{sLS2}$ represent the minimum and maximum offset values, respectively, so that, for values lower than $F_{sLI2}$ (second lower limit) such offsetting will be reestablished (assuming the value of $F_{sLs1}$), and, in a similar way, for values hither than $F_{sLS2}$ (second upper limit) the offsetting is reestablished, assuming the value of $F_{sLI1}$ (first lower limit).

The minimum and maximum offsetting value $F_{sLI2}$, $F_{sLS2}$ are related to the moment when the drive current of the compressor is zero, moments when the points PMS and PMI (FIG. 9) are detected and when, as a result, the counter-electromotive force generated by the motor is also null.

Following the description of the flowchart shown in FIG. 13, if the conditions steps 20 and 23 assume negative conditions, which would represent operation of the compressor 14 out of the limits of the structural resonance frequency $w_E$ (normal operation of the compressor), in this case the condition step 26 verifies whether the phase $F_s$ will be delayed, according to step 27. If not, the condition step 28 verifies whether $F_s>0$ and, if positive, the phase $F_s$ is advanced, if not, the cycle reaches its end.

Specifically, the "phase jump" is shown at steps 20 to 25, which take as a basis the verification of the drive frequency $w_A$. Steps 26 and 28 refer to the normal operation of the compressor ($w_A<F_{rLI}$ or $w_A>F_{rLS}$), and in this condition the phase $F_S$ (phase between the current and the displacement velocity) should be kept 0°.

For this reason, the condition step 26 delays the phase $F_s$ if $F_s<0$ and the condition 28 advances the phase $F_s$ if $F_s>0$, that is, such steps cause the offsetting to be equal to 0°, equivalent to the condition of normal operation of the compressor, thus guaranteeing the perfect operation tuning thereof.

Thus, the operation of the compressor 14 at the structural resonance frequency $w_E$ ($F_{rLI}<w_E<F_{rLS}$) will be prevented. Further, a new cycle will be started from the step 20 whenever the piston 1 reaches its upper dead center PMS or lower dead center PMNI (FIGS. 9, 10, and 11).

In a numerical example of said "phase jump" shown in FIG. 12, supposing that the phase Fs is at 0° and the lower limit $F_{rLI}$ of the structural resonance frequency is detected (due to the rise in temperature at which the compressor is arranged), the phase Fs will be delayed to 20° ($F_{sLs2}$) and then reestablished to −15° ($F_{sLI1}$), at the moment when the upper limit of the structural resonance frequency $F_{rLS}$ is detected, the phase will again be delayed to 0°. Obviously, such values are only preferred features of the present invention and should not be considered compulsory.

In a similar way, and considering now a drop in temperature of the environment where the compressor id arranged, upon detecting the upper limit $F_{rLS}$ of the structural resonance frequency, the phase Fs will assume the value −20° ($F_{sLI2}$) and then reestablished to 15° ($F_{sLs1}$).

The reason why the graph in FIG. 12 discloses two levels of "phase jump"—a first level being composed by the points $F_{sLs2}$ and $F_{sLI1}$ and a second level formed by the points $F_{sLs1}$ and $F_{sLI2}$—would be to prevent instability at the moment of the "jump", so that in the cases where only one level is used the occurrence of minor noises may entail indecision about which is the correct value of the phase which should be established.

These two level of phase jump are called levels of hysteresis and, in this preferred example, there is a hysteresis of 5°, since the first upper limit $F_{sLs1}$ and the second upper limit $F_{sLs2}$ assume preferable values of 15° and 20°, respectively.

It is important to mention that if the "phase jump" does not comprise the levels of hysteresis shown in FIG. 8 of the present application, in this case the maximum and minimum values of offsetting 15, 10 will be preferably 20° and −20°, respectively.

One can then establish an analogy between the graphs of FIGS. 8 and 12, in which the upper point 10 is equivalent to the upper limit $F_{rLS}$, the lower point 11 is equivalent to the lower limit $F_{rLI}$, the maximum offsetting 15 is equivalent to $F_{sLs2}$ and the minimum offsetting value 12 is equivalent to $F_{sLI2}$.

In an additional embodiment of the present invention, the operation of the resonant linear compressor 14 may be interrupted, if it is found that the drive frequency $w_A$ comprises values higher than $F_{rLI}$,11 and lower than $F_{rLS}$,10, that is, the lower limit and upper limit (respectively of the structural resonance frequency $w_E$.

Figure 14:
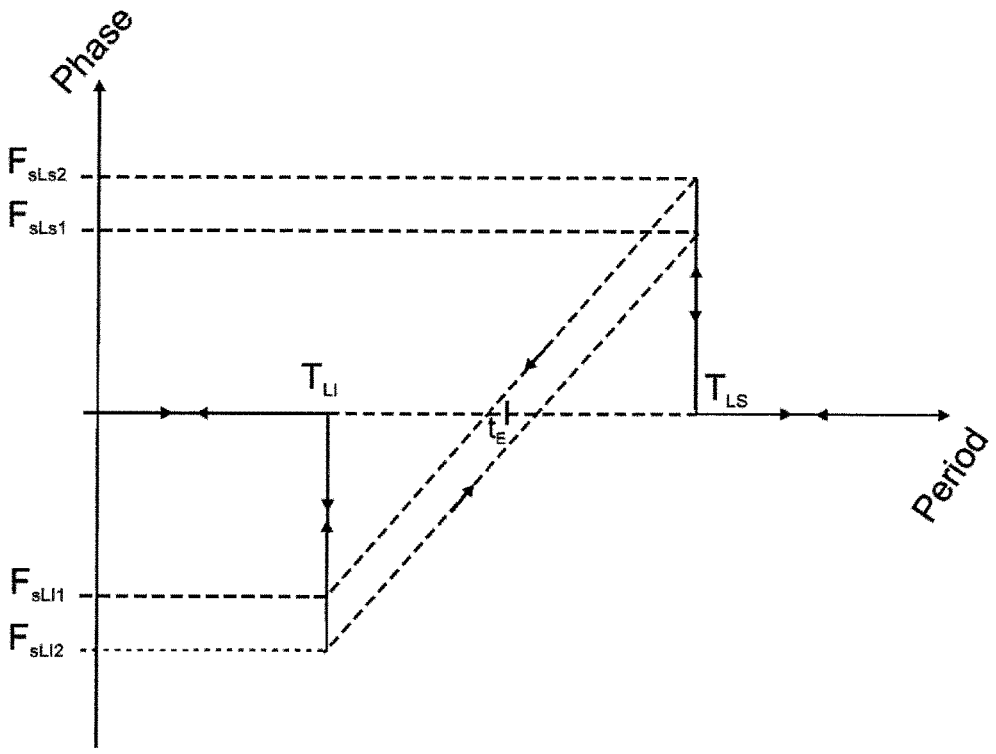
FIG. 14—is a representation of the drive period of the resonant linear compressor as a function of the phase between the piston velocity and the electric current.
Figure 15:
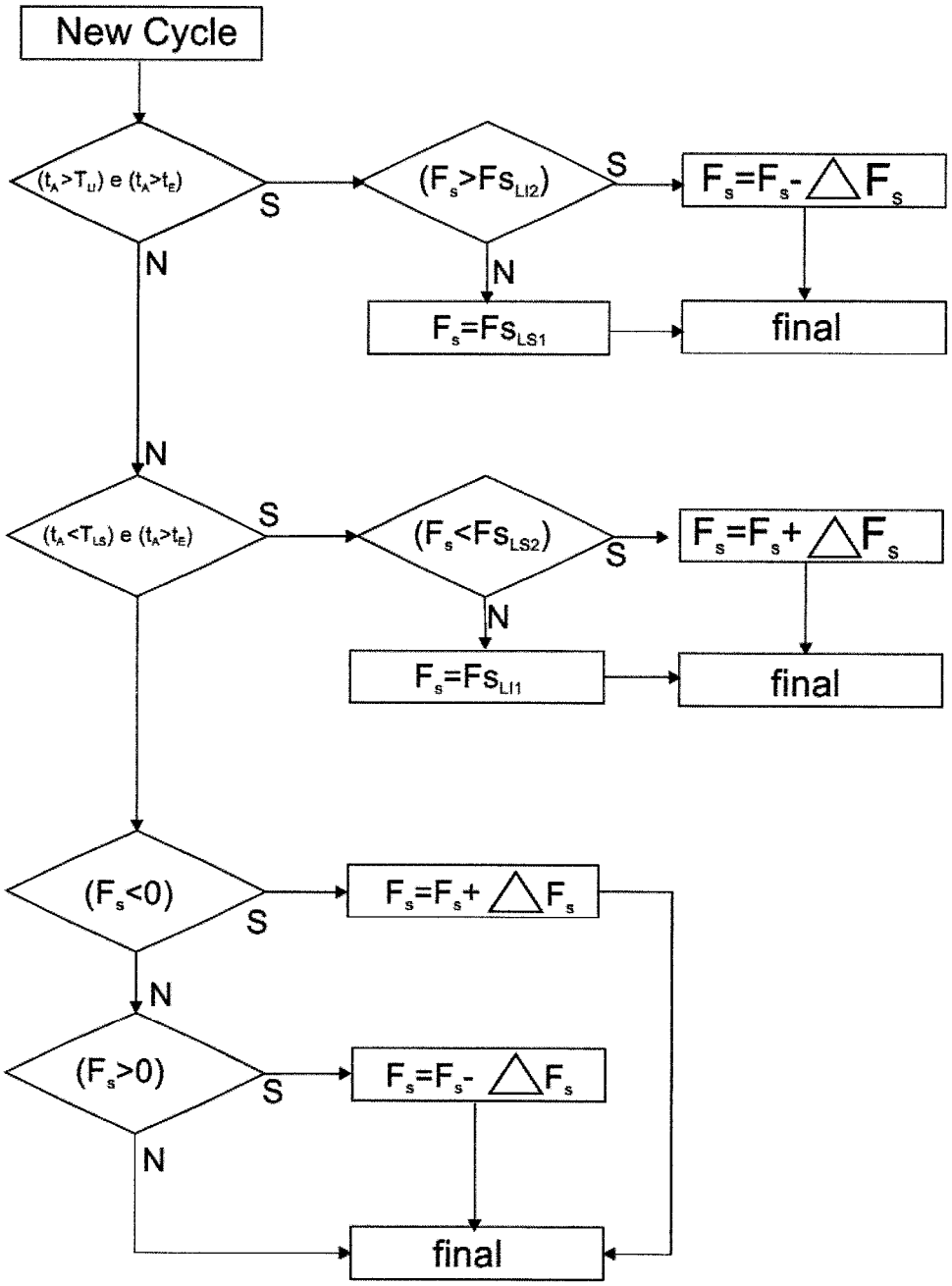
FIG. 15—represents a flowchart describing the "phase jump" according to the method proposed in the present invention, considering the drive period of the resonant linear compressor.

Further, the graph shown in FIG. 14 and the flowchart of FIG. 15 are analogous to those represented in FIGS. 12 and 13, respectively. More specifically, FIG. 14 represents a graph of the period with respect to the phase between the current and the velocity.

In this graph, instead of the structural resonance frequency $w_E$, a structural resonance period $t_E$ is represented, delimited by a lower limit $T_{LI}$ and an upper limit $T_{LS}$. On the other hand, the flowchart of FIG. 15 represents the control of the phase by the period from a drive period $t_A$. The steps exhibited in this flowchart are equivalent to those shown in FIG. 13, but it takes into consideration the period, not the drive frequency $w_A$ of the compressor 14.

The present invention further relates to a system for protecting a resonant linear compressor 14 capable of carrying out the method proposed in the present invention. In other words, said system is configured so as to prevent feed of the linear compressor at drive frequency $w_A$ whose harmonics coincide with the structural resonance frequency $w_E$ of the compressor 14.

Figure 16:
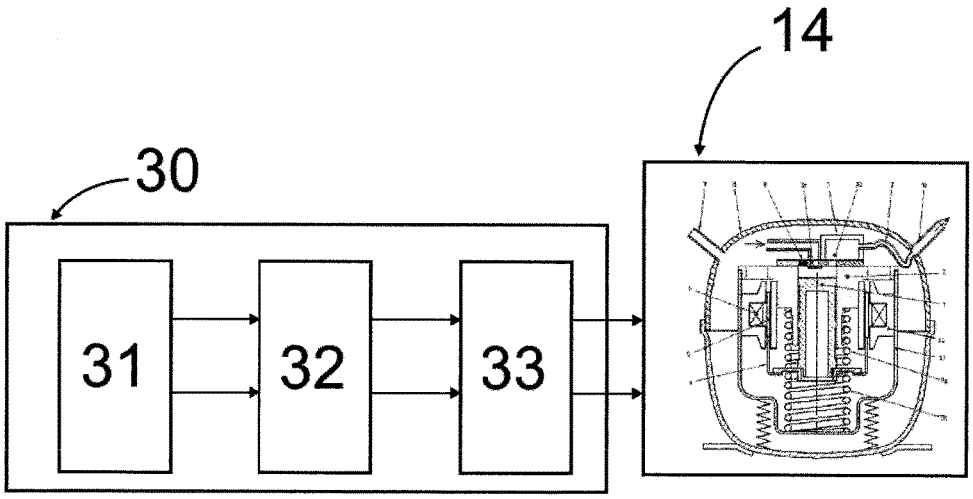
FIG. 16—is block representation of the system for protecting a resonant linear compressor as proposed in the present invention.

As can be observed from FIG. 16, said protection system is provided with an electronic control 30, the latter comprising at least one rectifier 31, one control unit 32 and one converter 33. The proposed system, by means of its electronic control 30, is capable of measuring the electric current i(t) of the motor, calculating the phase thereof, as well as a period of an operation cycle. Further, the system is configured so as to measure or estimate the displacement or the velocity of the piston, as well as calculating the phase thereof, and is further capable of measuring the counter-electromotive force of the linear compressor 14.

Additionally, the protection system proposed in the present invention is configured so as to advance or delay the phase between the electric current i(t) of the compressor 14 and the piston displacement velocity, if at least one harmonic of the drive frequency $w_A$ coincides with the structural resonance frequency $w_E$ of the resonant linear compressor 14, as can be observed in FIGS. 8 to 12 of the present invention.

Said protection system is further capable of reestablishing the phase between the electric current i(t) of the compressor and the piston displacement velocity, if the latter assumes values lower than the minimum offsetting value $F_{sLI2}$,12 or values higher than the maximum offsetting value $F_{sLS2}$,15, as shown in FIG. 12.

The proposed system is further capable of reestablishing the phase between the electric current i(t) of the compressor 14 and the piston displacement velocity, from a second upper limit $F_{sLS2}$ to a first lower limit $F_{sLI1}$ and from a second lower limit $F_{sLI2}$ to an first upper limit $F_{sLS1}$.

In an alternative configuration of the present invention, the protection system is further configured so as to interrupt the electric drive of the resonant linear compressor 14, if the electronic control 30 verifies that the drive frequency $w_A$ assumes values higher than a lower limit value $F_{rLI}$,11 and lower than an upper limit value $F_{rLS}$,10 of the structural resonance frequency $w_E$.

In other words, the proposed system can, instead of making the so-called "frequency jump", interrupt the operation of the linear compressor 14, if it is verified that the latter is at operation at a drive frequency $w_A$ that coincides with the structural resonance frequency $w_E$ of the compressor 14.

A preferred example of embodiment having been described, one should understand that the scope of the present invention embraces other possible variations, being limited only by the contents of the accompanying claims, which include the possible equivalents.

The invention claimed is:

1. A method for protecting a resonant linear compressor (14), which comprises structural resonance frequencies ($w_E$) and a motor that is fed by a feed voltage (Va) that has amplitude (A) and a drive frequency ($w_A$), both controlled according to the equation A·sin(wt), the method comprising a step of preventing feed to the motor at the drive frequencies ($w_A$) that have at least one harmonic coinciding with the structural resonance frequency ($w_E$) of the resonant linear compressor (14).

2. The method of protecting a resonant linear compressor (14) according to claim 1, in which the resonant linear compressor (14) comprises a piston (10), a cylinder (2), a motor and a sparing (7*a*, 7*b*), wherein the drive frequency ($w_A$) is derived from actuation of the spring (7*a*, 7*b*) and from the amplitude (A) of the feed voltage (Va) on the piston (1), which moves within the cylinder (2), the protection method comprising controlling a phase between an electric current i(t) of the compressor and the piston (1) displacement velocity.

3. The method of protecting a resonant linear compressor (14) according to claim 2, further comprising the step of establishing the phase between the electric current i(t) of the compressor and the piston-displacement velocity at 0°.

4. The method of protecting a resonant linear compressor (14) according to claim 2, further comprising the step of advancing the phase between the electric current i(t) of the compressor (14) and the piston displacement velocity, if at least one harmonic of the drive ($w_A$) coincides with the structural resonance frequency ($w_E$) of the resonant linear compressor (14).

5. The method of protecting a resonant linear compressor (14) according to claim 2, further comprising the step of delaying the phase between the electric current i(t) of the compressor (14) and the piston displacement velocity, if at least one harmonic of the drive frequency ($w_A$) coincides with the structural resonance frequency ($w_E$) of the resonant linear compressor (14).

6. The method of protecting a resonant linear compressor (14) according to claim 4, further comprising the step of reestablishing the phase between the electric current i(t) of the compressor and the piston displacement velocity, if it assumes at least one value lower than a minimum offsetting value ($F_{sLI2}$,12) or at least one value higher than a maximum offsetting value ($F_{sLS2}$,15).

7. The method of protecting a resonant linear compressor (14) according to claim 6, further comprising defining at least one first lower limit ($F_{sLI1}$) of the phase between the electric current i(t) of the compressor (14) and the piston displacement velocity, a second lower limit ($F_{sLI2}$), a first upper limit ($F_{sLS1}$) and a second upper limit ($F_{sLS2}$).

8. The method of protecting a resonant linear compressor (14) according to claim 7, further comprising the step of reestablishing the phase from the second upper limit ($F_{sLS2}$) to the first lower limit ($F_{sLI1}$) of the phase between the electric current i(t) of the compressor (14) and the piston displacement velocity.

9. The method of protecting a resonant linear compressor (14) according to claim 7, further comprising the step of reestablishing the phase from the second lower limit ($F_{sLI2}$) to the first upper limit ($F_{sLS1}$) of the phase between the electric current i(t) of the compressor (14) and the piston displacement velocity.

10. The method of protecting a resonant linear compressor (14) according to claim 1, further comprising the step of verifying whether the drive frequency ($w_A$) comprises harmonics that coincide with the structural resonance frequency ($w_E$).

11. The method of protecting a resonant linear compressor (14) according to claim 1, wherein the resonant linear compressor (14) comprises structural resonance frequencies ($w_E$) delimited by at least one lower limit value ($F_{rLI}$) and at least one upper limit value ($F_{rLS}$), the protection method further comprising the step of interrupting the operation of the resonant linear compressor (14), if the drive frequency ($w_A$) assumes values higher than the lower limit value ($F_{rLI}$) and lower than the upper limit value ($F_{rLS}$).

12. The method of protecting a resonant linear compressor (14) according to claim 5, further comprising the step of reestablishing the phase between the electric current i(t) of the compressor and the piston displacement velocity, if it assumes at least one value lower than a minimum offsetting value ($F_{sLI2}$,12) or at least one value higher than a maximum offsetting value ($F_{sLS2}$,15).

13. A system for protecting a resonant linear compressor (14), the resonant linear compressor (14) comprising structural resonance frequencies ($w_E$) and a motor that is fed by a feed voltage (Va) comprising amplitude (A) and a drive frequency ($w_A$) controlled according to the equation A·sin (wt), the protection system further comprising an electronic control (30), wherein:

the electric control (30) is configured so as to prevent feed to the motor at the drive frequencies ($w_A$) that have at least one harmonic coinciding with the structural resonance frequency ($w_E$) of the resonant linear compressor (14).

14. The system of protecting a resonant linear compressor (14) according to claim 13, wherein the electronic control (30) is further configured to control a phase between the electric current i(t) of the compressor (14) and the piston (1) displacement velocity.

15. The system of protecting a resonant linear compressor (14) according to claim 13, wherein the electronic control (30) is configured to advance the phase between the electric current i(t) of the compressor (14) and the piston displacement velocity, if at least one harmonic of the drive frequency ($w_A$) coincides with the structural resonance frequency ($w_E$) of the resonant linear compressor (14).

16. The system of protecting a resonant linear compressor (14) according to claim 14, wherein the electronic control (30) is configured to delay the phase between the electric current i(t) of the compressor (14) and the piston displacement velocity, if at least one harmonic of the drive frequency ($w_A$) coincides with the structural resonance frequency ($w_E$) of the resonant linear compressor (14).

17. The system of protecting a resonant linear compressor (14) according to claim 15, wherein the electronic control (30) is configured to reestablish the phase between the electric current i(t) of the compressor (14) and the piston displacement velocity, if it assumes at least one value lower than a minimum offsetting value ($F_{sLI2}$) or at least one value higher than a maximum offsetting value ($F_{sLS2}$).

18. The system of protecting a resonant linear compressor (14) according to claim 13, wherein the electronic control (30) is configured so as to verify whether the drive frequency ($w_A$) comprises harmonics that coincide with the structural resonance frequency ($w_E$).

19. The system of protecting a resonant linear compressor (14) according to claim 13, wherein the electronic control (30) is configured to reestablish the phase between the electric current i(t) of the compressor (14) and the piston displacement velocity from a second upper limit ($F_{sLS2}$) to a first lower limit ($F_{sLI1}$).

20. The system of protecting a resonant linear compressor (14) according to claim 13, wherein the electronic control (30) is configured to reestablish the phase between the electric current i(t) of the compressor (14) and the piston displacement velocity from a second lower limit ($F_{sLI2}$) to a first upper limit ($F_{sLS1}$).

21. The system of protecting a resonant linear compressor (14) according to claim 13, wherein the resonant linear compressor (14) further comprises structural resonance frequencies ($w_E$) delimited by at least one lower limit value ($F_{rLI}$) and at least one upper limit value ($F_{rLS}$), wherein the electronic control (30) is configured so as to interrupt the operation of the resonant linear compressor (14), if the drive frequency ($w_A$) assumes values higher than the lower limit value ($F_{rLI}$) and lower than the upper limit value ($F_{rLS}$).

22. The system of protecting a resonant linear compressor (14) according to claim 16, wherein the electronic control (30) is configured to reestablish the phase between the electric current i(t) of the compressor (14) and the piston displacement velocity, if it assumes at least one value lower than a minimum offsetting value ($F_{sLI2}$) or at least one value higher than a maximum offsetting value ($F_{sLS2}$).

* * * * *